US008671962B1

(12) United States Patent
Dodson

(10) Patent No.: US 8,671,962 B1
(45) Date of Patent: Mar. 18, 2014

(54) WALKER GLIDE ASSEMBLY

(76) Inventor: Rodney Dodson, Boynton Beach, FL (US)

( * ) Notice: Subject to any disclaimer, the term of this patent is extended or adjusted under 35 U.S.C. 154(b) by 1028 days.

(21) Appl. No.: 12/583,436

(22) Filed: Aug. 21, 2009

Related U.S. Application Data

(63) Continuation-in-part of application No. 12/114,229, filed on May 2, 2008, now Pat. No. 7,637,274.

(51) Int. Cl.
*A45B 9/04* (2006.01)

(52) U.S. Cl.
USPC ..... 135/84; 135/86

(58) Field of Classification Search
USPC ..... 135/77, 78, 82, 84, 86; 16/42 R
See application file for complete search history.

(56) References Cited

U.S. PATENT DOCUMENTS 2,857,616 A * 10/1958 Becker ..... 16/42 R
2,973,545 A * 3/1961 Kramcsak, Jr. ..... 16/42 R
3,505,724 A * 4/1970 Karl et al. ..... 29/432.2
4,440,186 A 4/1984 Lottner
4,899,771 A 2/1990 Wilkinson
4,947,882 A 8/1990 Levasseur
5,170,972 A * 12/1992 Casals Guell ..... 248/188.9
5,865,204 A 2/1999 Bracy
6,883,530 B2 4/2005 Kawakami
7,558,044 B2 * 7/2009 George et al. ..... 361/231
2006/0219280 A1 10/2006 Robinson

FOREIGN PATENT DOCUMENTS

EP 112141 A2 * 6/1984

* cited by examiner

*Primary Examiner* — David R Dunn
*Assistant Examiner* — Danielle Jackson
(74) *Attorney, Agent, or Firm* — Alvin S. Blum

(57) ABSTRACT

An articulating glide assembly for use on the leg of a walker includes an adapter with a sleeve having an open end to receive the free end of the walker leg. A base at the bottom end of the sleeve supports the downward force exerted by the walker. A hole in the base receives an upwardly directed pin extending from an articulating foot that is movably engaged with the base. The worn foot may be easily pulled from the base and replaced with a new foot as required.

8 Claims, 6 Drawing Sheets

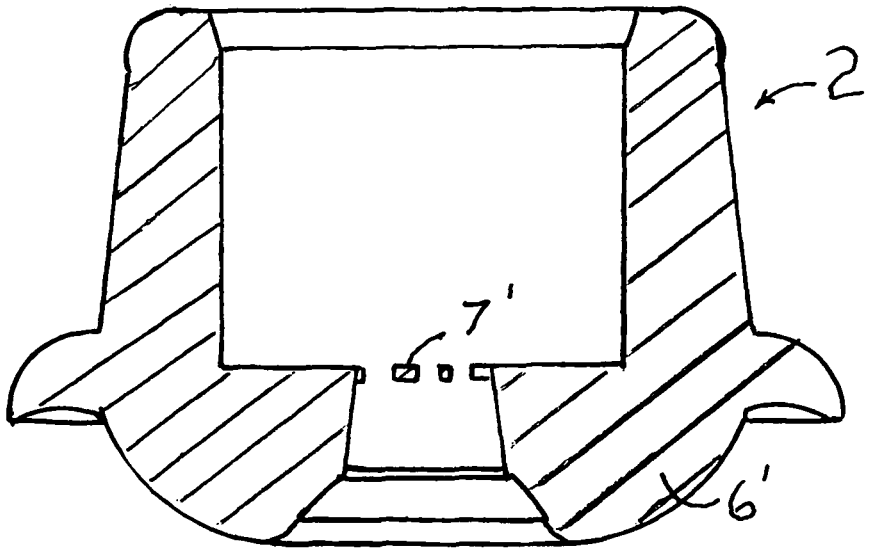
FIG. 6
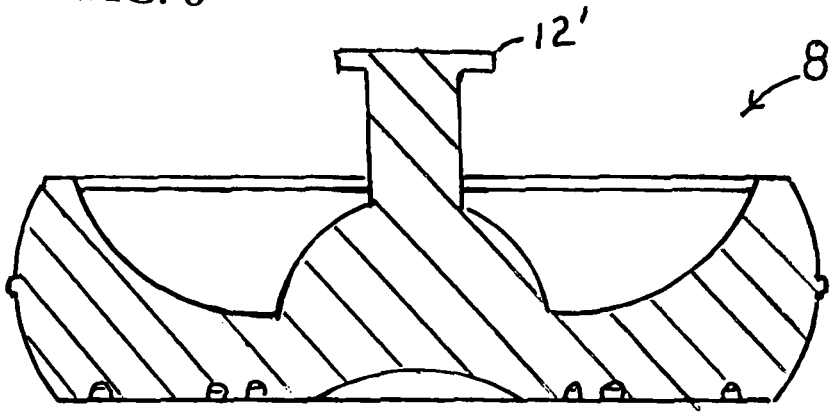

WALKER GLIDE ASSEMBLY

This is a continuation in part of U.S. patent application Ser. No. 12/114,229 filed May 2, 2008 now U.S. Pat. No. 7,637, 274, incorporated herein by reference.

BACKGROUND OF THE INVENTION

This invention relates to articulating glide assemblies for use on the ends of the legs of walkers that assist disabled individuals to walk. The legs of a walker generally consist of metal tubes. The free ends of the tubes are covered with a cap or glide to provide a more stable contact with the floor and to prevent damage to the floor as the walker is advanced. If the user drags the walker along, the glide wears by frictional contact with the floor. The legs often rest at an angle to the floor that puts only a portion of a non-articulating glide in floor contact.

When the glide does not make full floor contact, it is more likely to catch on an uneven floor. Articulating glides that will enable the bottom of the glide to make full contact with the floor will enhance the stability of the walker. Because walker users drag the glides on the floor, they wear out and must be replaced. A non-articulating glide will wear more rapidly and unevenly. The users and their attendants often are not able to replace standard glides, because they are so difficult to remove from the walker leg. It would be useful to have glides with a bottom portion that can be easily replaced.

SUMMARY OF THE INVENTION

It is accordingly an object of the invention to provide an articulating glide assembly for the legs of a walker that adapts to the angle at which the leg contacts the floor to prevent undue uneven wear. It is another object that the glide assembly include a bottom portion for contacting the floor that is inexpensive and easily replaceable.

The articulating glide assembly of the invention comprises a first member having a sleeve for engaging a free end of a walker leg and a base for supporting the downward force exerted by the walker. The base defines a hole for removably receiving a portion of an articulating foot that is movably engaged by the base. The bottom of the foot has a broad flat surface adapted for engaging the floor. The articulating foot is easily removed by pulling it free from the first member. A new foot is easily replaced by inserting the portion of the foot into the hole in the first member and pressing firmly.

These and other objects, features, and advantages of the invention will become more apparent from the detailed description of an exemplary embodiment thereof as illustrated in the accompanying drawings, in which like elements are designated by like reference characters in the various drawing figures.

BRIEF DESCRIPTION OF THE DRAWINGS

FIG. 6 is a sectional view of another embodiment of the invention.

DETAILED DESCRIPTION OF PREFERRED EMBODIMENTS

Figure 1:
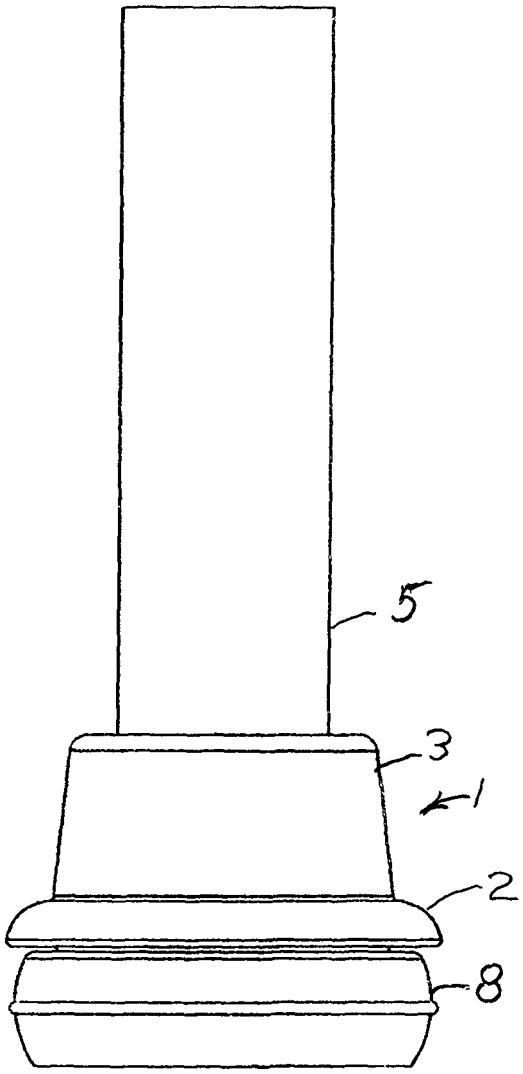
FIG. 1 is a side elevation of the glide assembly.
Figure 2:
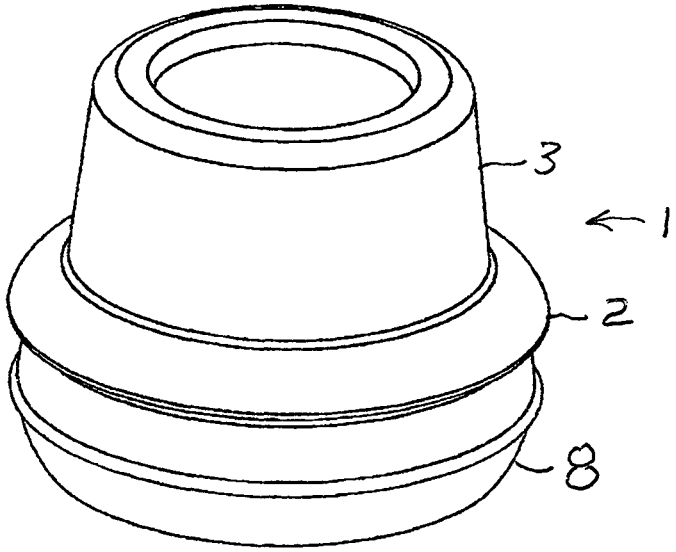
FIG. 2 is a perspective view of the glide assembly.
Figure 3:
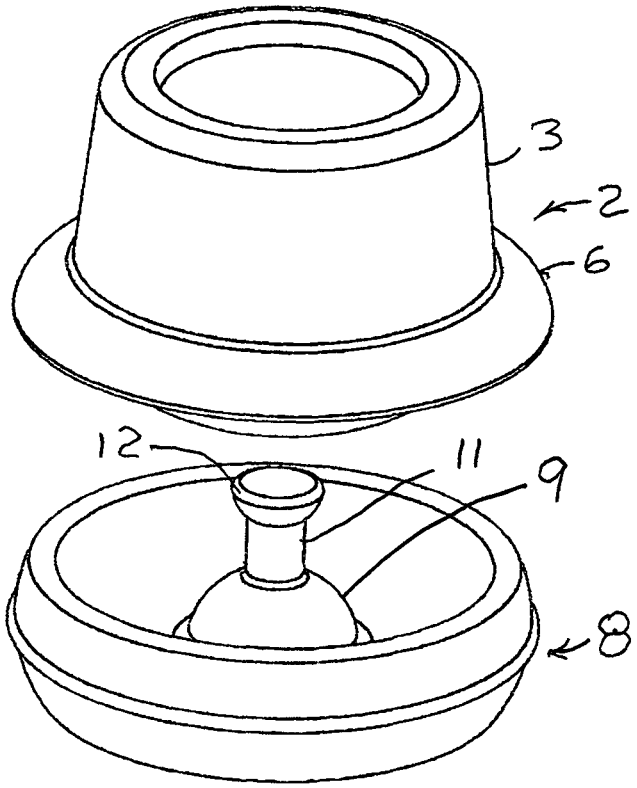
FIG. 3 is a perspective view of the disassembled glide assembly.
Figure 4:
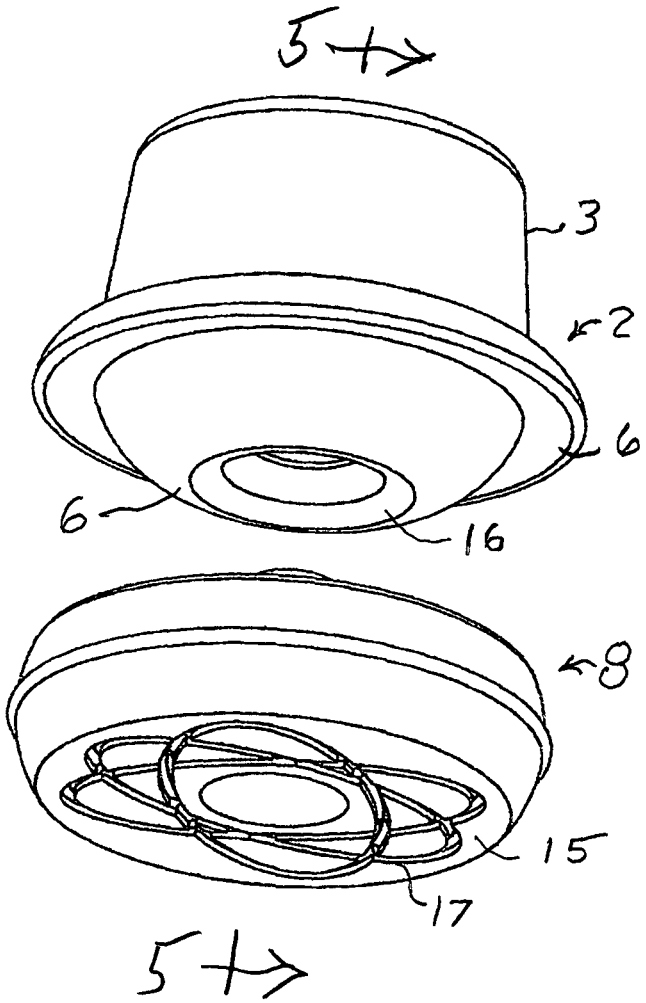
FIG. 4 is an underside perspective view of the disassembled glide assembly.
Figure 5:
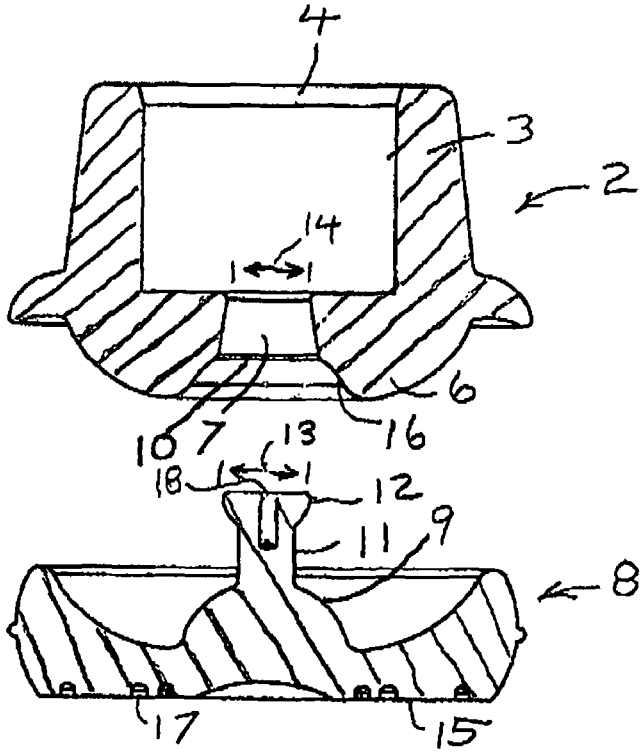
FIG. 5 is a sectional view through line 5-5 of FIG. 4.

Referring now to drawing FIGS. 1-5, an articulating glide assembly 1 of the invention includes an adapter 2 having an annular sleeve 3 defining an opening 4 at the top end for receiving the leg 5 of a walker. A base 6 at the bottom end of the sleeve supports the downward force of the walker applied by the user. The base 6 provides a hole 7 through the central axis of the base. An articulating foot 8 has a flat bottom 15 for stable contact with the floor and an upwardly extending spherical surface 9 at the top of the foot, with a pin 11 affixed to the foot extending upwardly from the spherical surface. The spherical surface 9 engages a chamfered surface 16 on the bottom edge 10 of the hole 7. A retainer 12 affixed to an upper end of pin 11 has an outside diameter 13 greater than an inside diameter 14 of a portion of hole 7 so that the foot will not inadvertently fall off the base during use. As shown in FIG. 5, the retainer 12 may be provided with one or more slots 18 to enhance the flexibility of the retainer. The retainer is positioned on the pin so that when the walker is lifted, the foot 8 will drop down from the base far enough so that the spherical surface 9 of the foot is not in contact with the chamfered surface 16 of the base. The hole 7 in the base is larger than the pin so that, when the walker is next put down on the floor, the foot may articulate to an angle of as much as twenty degrees with respect to a longitudinal axis of the sleeve to rest the entire bottom of the foot on the floor.

The flat bottom 15 of the foot will wear more uniformly than the prior art because of the articulation feature. A wear indicator 17 on the bottom surface in the form of one or more concavities will alert the user to a need for replacing the foot when the indicator is worn off. At least one of the retainer 12 and/or the hole 7 is provided with sufficient flexibility to enable a person to pull the foot off the base and to push a replacement foot onto the base.

Referring now to FIG. 6, another embodiment of the invention is shown in which retainer 12' is a flat plate, and the hole 7' is slotted at its upper end to enhance its flexibility to facilitate replacement of the foot 8' through the hole 7' in base 6'.

What is claimed is:

1. An articulating glide assembly for use on a walker that assists disabled individuals to walk, the articulating glide assembly comprising:

an adapter having an annular sleeve defining an opening at a top end thereof for engaging a leg of a walker;

a base at a bottom end of the sleeve for supporting the downward force exerted by the walker, the base defining a hole therethrough;

an articulating foot having an upwardly extending spherical surface from a top of the foot and a pin extending upwardly from the spherical surface, the spherical surface engaging an edge of the hole in the base and the pin extending through the hole and movably engaged therein;

a retainer engaged on an upper portion of the pin, the retainer having an outside diameter larger than the inside diameter of a portion of the hole in the base to thereby retain the foot on the base;

the edge of the hole in the base being spherically chamfered for engagement with the spherical surface on the foot;

at least one of the hole and the retainer being sufficiently resilient to enable the retainer to pass through the hole when the foot is pulled from the adapter or pushed to the adapter; and a flat bottom of the foot adapted to engage a floor surface.

2. The articulating glide assembly according to claim 1 in which the hole in the base is larger than the pin to allow the spherical surface of the foot to angularly articulate in the spherical chamfer.

3. The articulating glide assembly according to claim 1 in which the hole in the base is sufficiently large to permit the foot to articulate at least twenty degrees with respect to a longitudinal axis of the sleeve.

4. The articulating glide assembly according to claim 1 wherein the flat bottom includes a wear indicator.

5. The articulating glide assembly according to claim 4 wherein the wear indicator is a concavity in a bottom surface of the foot.

6. An articulating glide assembly for use on a walker that assists disabled individuals to walk, the articulating glide assembly comprising:

an adapter having an annular sleeve defining an opening at a top end thereof for engaging a leg of a walker;

a base at a bottom end of the sleeve for supporting the downward force exerted by the walker, the base defining a hole therethrough;

an articulating foot having an upwardly extending spherical surface from a top of the foot and a pin extending upwardly from the spherical surface, the spherical surface engaging an edge of the hole in the base and the pin extending through the hole and movably engaged therein;

a retainer engaged on an upper portion of the pin, the retainer having an outside diameter larger than the inside diameter of a portion of the hole in the base to thereby retain the foot on the base;

the edge of the hole in the base being spherically chamfered for engagement with the spherical surface on the foot;

at least one of the hole and the retainer being sufficiently resilient to enable the retainer to pass through the hole when the foot is pulled from the adapter or pushed to the adapter;

a flat bottom of the foot adapted to engage a floor surface;

the hole in the base being larger than the pin to allow the spherical surface of the foot to angularly articulate in the spherical chamfer; and the flat bottom including a wear indicator in the form of a concavity in a bottom surface of the foot.

7. An articulating glide assembly for use on a walker that assists disabled individuals to walk, the articulating glide assembly comprising:

an adapter having an annular sleeve defining an opening at a top end thereof for engaging a leg of a walker;

a base at a bottom end of the sleeve for supporting the downward force exerted by the walker, the base defining a hole therethrough;

the hole in the base, at a bottom edge thereof, having a spherically chamfered surface;

an articulating foot having an upwardly extending spherical surface from a top of the foot, the spherical surface constructed for engaging the spherically chamfered surface;

a pin fixed to the foot extending upwardly from the spherical surface, the pin extending through the hole and movably engaged therein;

a retainer affixed to an upper portion of the pin, the retainer having an outside diameter larger than the inside diameter of a portion of the hole in the base to thereby retain the foot on the base;

at least one of the hole and the retainer being sufficiently resilient to enable the retainer to pass through the hole when the foot is pulled from the adapter or pushed to the adapter;

a flat bottom of the foot adapted to engage a floor surface;

the retainer being positioned high enough on the pin so that when the walker is lifted, the foot will drop down from the base far enough that the spherical surface of the foot is not in contact with the chamfered surface of the base: and the hole in the base being larger than the pin to allow the spherical surface of the foot to angularly articulate relative to the spherically chamfered surface when the walker is lifted.

8. The articulating glide assembly according to claim 7 in which the flat bottom includes a wear indicator in the form of a concavity in a bottom surface of the foot.

* * * * *